US005580173A

United States Patent [19]

Sebastian

[11] Patent Number: 5,580,173

[45] Date of Patent: Dec. 3, 1996

[54] FOLDING BAG

[76] Inventor: James Sebastian, 116 E. 16th St., 10, New York, N.Y. 10003

[21] Appl. No.: 257,908

[22] Filed: Jun. 10, 1994

[51] Int. Cl.[6] ..... B65D 30/10

[52] U.S. Cl. ..... 383/76; 383/119; 383/120; 383/121; 383/906

[58] Field of Search ..... 383/76, 120, 119, 383/121, 104, 906, 75

[56] References Cited

U.S. PATENT DOCUMENTS

| | | | |
|---|---|---|---|
| 1,951,011 | 3/1934 | Felk | 383/120 X |
| 3,327,924 | 6/1967 | Brutting | 383/76 X |
| 3,680,445 | 8/1972 | Pearl et al. | 383/121 X |

FOREIGN PATENT DOCUMENTS

| | | | |
|---|---|---|---|
| 1535316 | 8/1968 | France | 383/121 |
| 1245275 | 7/1967 | Germany | 383/121 |
| 404154555 | 5/1992 | Japan | 383/119 |
| 404201860 | 7/1992 | Japan | 383/119 |
| 405168509 | 7/1993 | Japan | 383/76 |

*Primary Examiner*—Jes F. Pascua
*Attorney, Agent, or Firm*—Peter T. Cobrin; Cobrin Gittes & Samuel

[57] ABSTRACT

A folding bag according including front and rear pliable rectangular faces, each face including a rigid base panel region. When the bag is in its first, closed position, the front and rear faces lie flat against each other. When the bag is in its second, open position, the base panels, which are hingeably attached to each other, open up to form part of the bottom of the bag, with the pliable portion of the faces remaining substantially parallel to each other, separated by the two base panels. The sides of the bag are provided by pliable right and left faces that are pleated and mounted to the front and rear faces and to the bottom the base panels are hinged in such a way that when the bag is in its first, closed position, the right and left faces are tucked between the front and rear faces such that the closed bag is a rectangle of substantially uniform thickness.

11 Claims, 5 Drawing Sheets

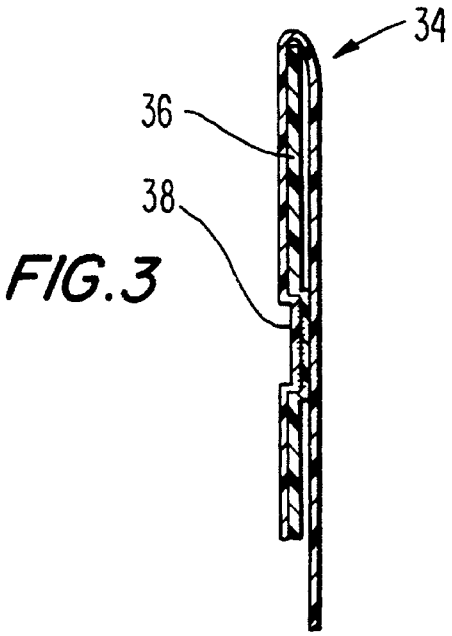
FIG.3
FIG.4
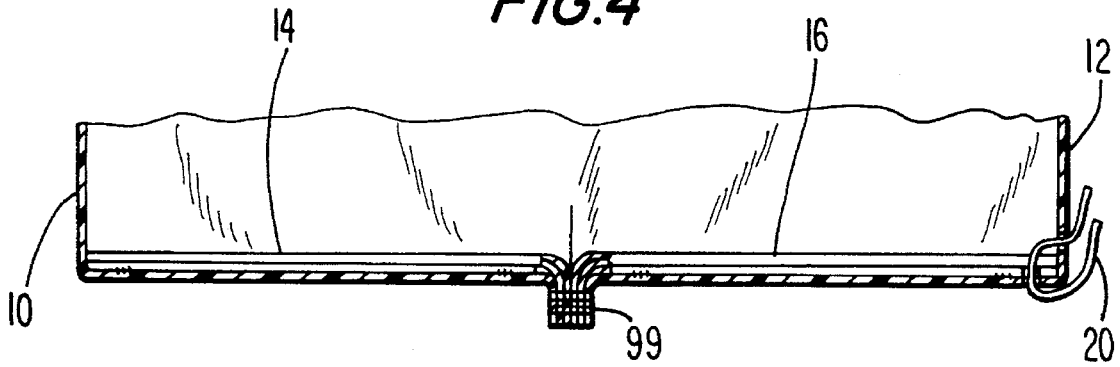

FOLDING BAG

DESCRIPTION

1. Field of the Invention

The present invention relates generally to bags, pouches, and other articles of manufacture used for the transporting and storage of goods, and in particular to such articles of manufacture that are foldable into a predetermined compact configuration.

2. Background Art

Bags and pouches have been used in many different areas of human endeavor, most notably in the area of retail sales of relatively small items, such as groceries, hardware, and supplies of various kinds. Bags are typically mass produced from paper or plastic and are designed to be disposed of after a single use. In addition, there are various ways in which the bags are folded for storage. The simplest bags, requiring no folding, are essentially two flat, rectangular sheets of material bound at three edges, with the fourth, unbounded edge serving as the mouth of the bag. Other bags, such as the familiar paper grocery bag, are three dimensional, providing a rectangular base and four faces continuous with the base. These bags provide a crude arrangement for folding the faces and the base to create a relatively flat rectangle for storage.

Although these prior art bags are inexpensive to manufacture and generally serve the purposes for which they are designed, they suffer from known disadvantages. Paper bags are of limited strength and are not waterproof. Many plastic bags are as weak as, or weaker than, paper bags, especially when the bag is used to transport sharp or pointed objects. Further, plastic bags typically lack any structural support elements to distribute the weight of the load. Finally, both the prior art plastic and paper bags raise environmental issues. Although many paper bags and some plastic bags are constructed from recyclable material, neither bag is designed for more than one or two uses. Even if a bag is 100 percent recyclable, the recycling process requires the consumption of energy and other resources, and unnecessary recycling and itself contributes to the overall decline in environmental quality.

It can thus be seen that there is a need for a structurally sound, reusable bag of a useful size that is readily foldable into a compact shape and that can be inexpensively manufactured from a single recyclable material.

DISCLOSURE OF INVENTION

A preferred embodiment of a folding bag according to the present invention includes front and rear pliable rectangular faces, each face including a rigid bottom panel region. When the bag is in its first, closed position, the front and rear faces lie flat against each other. When the bag is in its second, open position, the bottom panels, which are hingeably attached to each other, open up to form part of the bottom of the bag, with the pliable portion of the faces remaining substantially parallel to each other, separated by the two bottom panels. The sides of the bag are provided by pliable right and left faces that are pleated and mounted to the front and rear faces and to the bottom panel hinge in such a way that when the bag is in its first, closed position, the right and left faces are tucked between the front and rear faces such that the closed bag is a rectangle of substantially uniform thickness. When the bag is in its second, open position, the pleats of the upper portion of the right and left faces open flat to form the sides of the bag, and the pleats of the lower portion of the right and left faces open partway to form, together with the bottom panels of the front and rear faces, the bottom of the bag.

In a further preferred embodiment of the present invention, the mouth of the bag is reinforced with a hemmed region at the upper edges of the four faces. The hemmed region of the front and rear faces includes hem reinforcement panels of the same width as, and in line with, the bottom panels. Additionally, a drawstring may be passed through holes in the hemmed region, in the rear face, and in the rear bottom panel.

BRIEF DESCRIPTION OF THE DRAWINGS

The foregoing features of the invention may be better understood with reference to the following description taken together with the accompanying drawings in which:

FIG. 3 is a cross section of the hem region of a preferred embodiment of the present invention, taken through the plane 3—3 of FIG. 2;

FIG. 4 is a cross section of the bottom panels and hinge of a preferred embodiment of the present invention, taken through the plane 4—4 of FIG. 2;

DETAILED DESCRIPTION OF SPECIFIC EMBODIMENTS

Figure 1A:
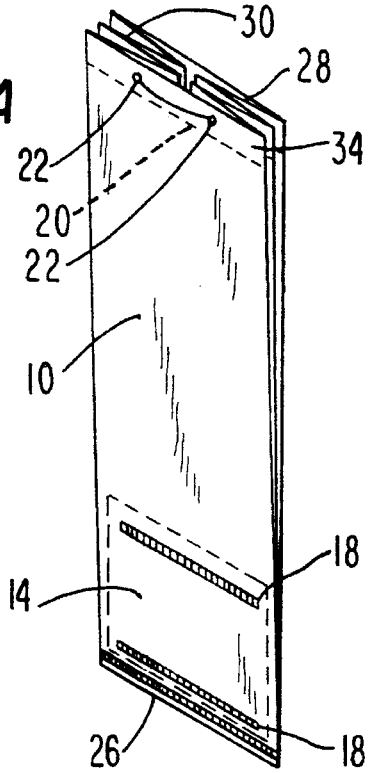
FIGS. 1A and 1B are, respectively, front and rear perspective views of an embodiment of a folding bag according to the present invention, in which the folding bag is in its first, closed position.
Figure 1B:
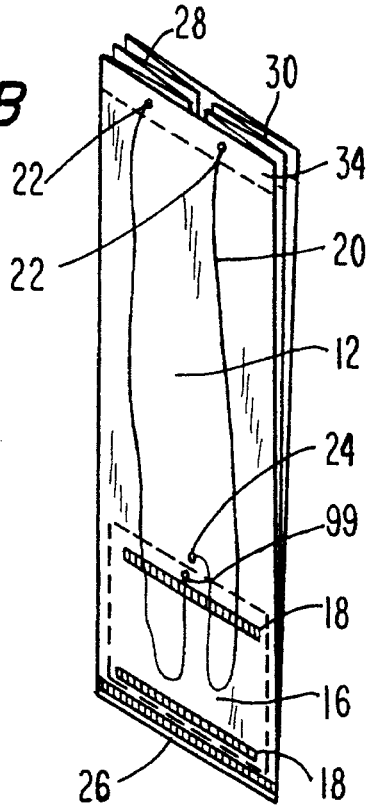
Figure 2:
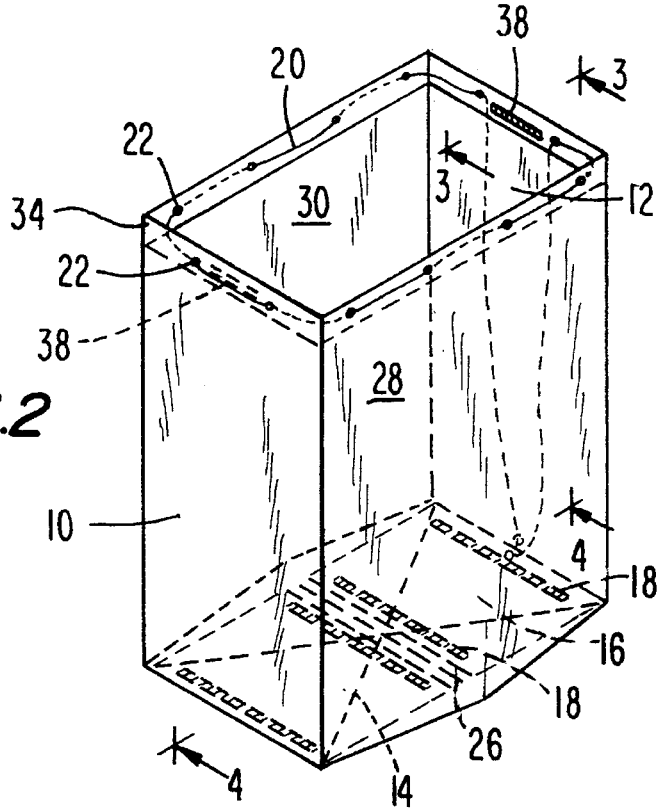
FIG. 2 is a front perspective view of an embodiment of the present invention, in which the folding bag is in its second, open position.

In a preferred embodiment of a folding bag according to the present invention, the bag has two basic configurations. FIGS. 1A and 1B show, respectively, front and rear perspective views of the folding bag in its first, closed configuration, in which the bag lies flat for storage. FIG. 2 shows a perspective view of the folding bag in its second, open configuration, in which the bag is unfolded to receive its contents.

As shown in FIGS. 1A and 1B, when the bag is in its first, closed configuration, the bag displays two flat, rectangular faces, a front face 10 and a rear face 12. The front face 10 and rear face 12 are soft and pliable, save for a rigid, rectangular panel 14, 16 at the bottom of each of the two faces. As will be seen, these bottom panels contribute to the structural integrity of the bag when it is in its second, open configuration.

In the present preferred embodiment, it is contemplated that the front face 10 and rear face 12, the bottom panels 14, 16, and the remaining components of the folding bag, will all be made of the same material. This is advantageous in manufacturing as only one supplier would be needed, and would be advantageous in recycling as well, as the components would not have to be separated prior to processing. One suggested material is polypropylene, which is recyclable, and which is commercially available in various forms, including pliable, clothlike material, rigid sheets, and woven string. Further, polypropylene is inexpensive, sturdy and durable, and has the added advantage that polypropylene components may be mounted to each other using heat bonding techniques known in the art, thus obviating the need for adhesives. One particularly advantageous form of polypropylene that can be used for the pliable faces of the bag is a clothlike material that is water-resistant, yet porous, thus maximizing the bag's utility without the attendant risk of suffocation.

In the preferred embodiment shown in FIGS. 1A and 1B, the front bottom panel 14 and rear bottom panel 16 are formed by mounting a rigid rectangular piece of polypropylene to the inside surfaces of the front face 10 and rear face 12, respectively. The particular heat bonding technique used in the present embodiment creates a pair of parallel seams 18 proximate to the top and bottom edges of the bottom panels 14, 16. However, other mounting techniques known in the art may also be used. Although the bottom panels in the present embodiment are separate pieces mounted to the pliable material making up the front and rear faces, it would be possible using techniques known in the art to make both the front and rear faces out of one continuous piece of material.

It will be seen in FIGS. 1A and 1B that the addition of the rigid bottom panels 10, 12 in essence divides the front face 10 and rear face 12 into a pliable upper portion and a rigid bottom portion. The front and rear faces 10, 12 are identical, save for the arrangement of a drawstring 20, which can be used both to close and to carry the bag. As is apparent FIG. 1A, in the front face 10 the drawstring is strung through two holes 22 at the top of the face. In FIG. 1B, it will be seen that in addition to the top holes 22, the rear face provides two more holes 24, 99 to allow the drawstring 20 to extend down the length of the rear face 12. This arrangement permits greater flexibility and control in carrying the bag. For example, the user of the bag may use the extension of the drawstring 20 down the rear face 12 to carry the bag around his or her shoulder. Alternatively, the extension of the drawstring down the rear face may be used to hang the bag from a support of some kind, such as the handlebars of a bicycle.

As can be seen, one of the two holes 99 actually passes through the rigid rear bottom panel 16. This arrangement adds to the strength of the bag, minimizing the risk that the drawstring 20 will rip through the material at the bottom of the bag.

The front and rear faces are heat bonded to each other at their bottom edges, creating a hinge 26 for the bottom panels 14, 16. As shown in FIG. 2, when the bag is opened, the bottom panels 14, 16 open up into a flat rectangle that helps to define the bag's bottom. If the bottom panels 14, 16 have a width W and a length L, the bottom panels 14, 16 will open up into a rectangle of width W and length 2 L.

Figure 2A:
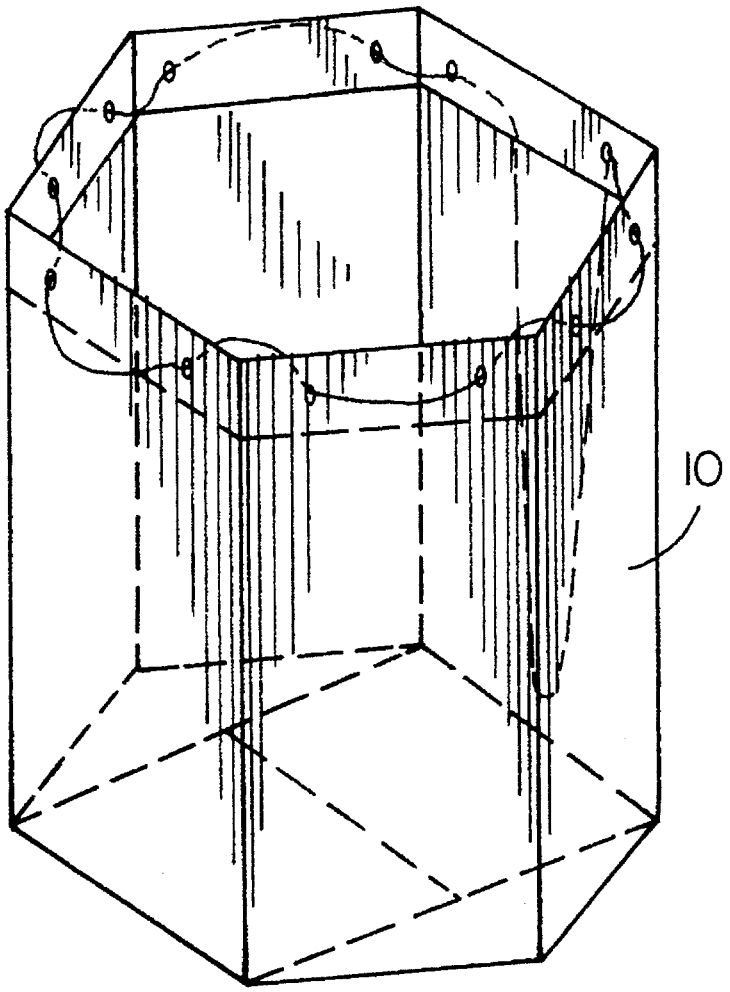
FIG. 2A is a view of an embodiment of the invention in which the bag has a hexagonal bottom and hexagonal sectional shape.

FIG. 2A shows an embodiment of the invention in which the bag has a hexagonal bottom and a hexagonal sectional shape. This is further discussed below in connection with FIG. 5.

FIG. 4 shows a cross section of the bottom panels 14, 16 and hinge 26 of the preferred embodiment shown in FIG. 2 when the bag is in its second, open position. The seam resulting from the heat bonding process marks the location of the hinge 26.

The rigid rectangle formed by the two bottom panels 14, 16 when the bag is in its second, open position, contributes to the strength and durability of the bag. First, the rigid bottom panels are more resistant to damage from sharp objects than is the clothlike material making up the faces of the bag. Second, the rigid bottom panels serve to distribute the weight of objects contained in the bag across a wider area, thus allowing heavier objects to be carried in the bag. Finally, the rigid bottom panels keep the bottom of the bag from wearing out prematurely.

As shown in FIG. 2, when the bag is in its second, open configuration, the upper, pliable portion of the front face 10 and rear face 12 are parallel to each other, but separated by a distance of 2L. The bottom panels 14, 16 in the open position are now perpendicular to the front and rear faces 10, 12. FIG. 2 also shows the right face 28 and left face 30, which define the sides and part of the bottom of the bag. The upper edges of the left and right faces 28, 30, together with the upper edges of the front and rear faces 10, 12, define the mouth of the bag.

As shown in FIGS. 1A, 1B, and 2, the right and left faces 28, 30 of the bag are 2 W in width and are pleated by three equidistant creases that are ½W apart. As shown in FIGS. 1A and 1B, the first and third creases point towards the inside of the bag, and the second crease points outward. The choice of this pleating arrangement and these particular dimensions allows the bag to be folded into a relatively compact shape of substantially uniform thickness. As is apparent in FIGS. 1A and 1B, when the bag is in its first, closed position, the pleated right and left faces 28, 30 fold into two rectangles of width ½W, which fit neatly between the front and rear faces 10, 12, meeting at a line bisecting the front and rear faces down their respective lengths.

In the present preferred embodiment, the bottom edge of the pleated right and left faces 28, 30, which are the same length as the front and rear faces 10, 12, are mounted onto the bottom hinge 26. This arrangement is advantageous because when the bag is opened, the pleats fold outward in a manner shown in FIG. 5, which is a plan view of the bottom of the bag when the bag is in its second position.

Figure 5:
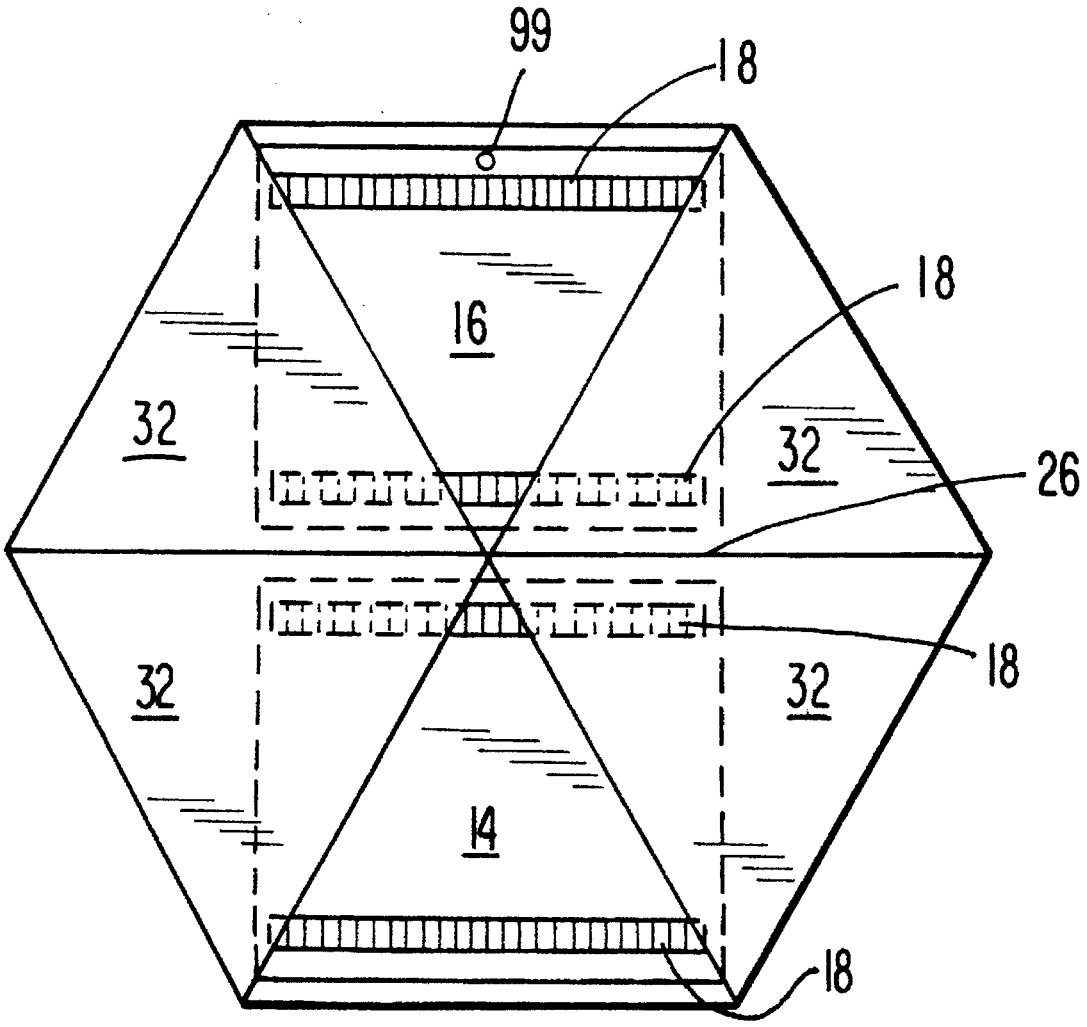
FIG. 5 is a plan view of the bottom of an embodiment of the present invention when the bag is in its second, open position.

As shown in FIG. 5, the bottom of the bag is hexagonal. The folding out of the pleats creates triangular folds of material 32 that partially cover the bottom panels 14, 16. This is advantageous because it permits the manufacture of the bottom panels 14, 16 by the heat bonding of rectangles of polypropylene to the inside of the front and rear faces 10, 12 without the risk that the bottom panels 14, 16 may be accidentally dislodged, either by the contents of the bag, or by the user reaching into the bag. In addition, the triangular folds of material 32 covering the bottom panels 14, 16 also protect the contents of the bag from possible damage from the corners or edges of the bottom panels 14, 16.

The hexagonal shape of the bottom provides an added advantage by building in a certain amount of leeway to the amount that the bag can hold. If the object or objects being carried or stored in the bag exceed the confines of the rectangle defined by the bottom panels 10, 12, the hexagonal bottom provides additional material to accommodate the excess.

The hexagonal shape of the bottom dictates the ratio of the length L and width W of the bottom panels. As can be seen in FIG. 5, the length L of a bottom panel 14, 16 is the altitude of an equilateral triangle with base W. Thus, following the known geometrical relationship between the base and altitude of an equilateral triangle, the preferred length of a bottom panel 14, 16 is $\frac{1}{2}W \times \sqrt{3}$, or approximately 0.87 W.

Therefore, when the bag is in its second, open position, the rectangle formed by the two bottom panels 14, 16 has dimensions of W×1.73 W.

As shown in FIG. 2, in the present preferred embodiment, the bag is provided with an upper hem 34, which is formed by folding over the uppermost edge of the four faces of the bag 10, 12, 28, 30. The hem 34 prevents fraying of the upper edge of the bag material, thereby prolonging the life of the bag. Further, the hem 34 provides a reinforced region for holes 22 through which a drawstring 20 may be threaded. As previously noted, the drawstring 20 is preferably made out of the same material as the faces 10, 12, 28, 30 and the bottom panels 14, 16 for ease of manufacturing and recycling.

As shown in FIG. 3, which is a cross section of the hem region of the preferred embodiment shown in FIG. 2, there are also provided hem reinforcement panels 36 of width W in the upper edge of the front and rear faces 10, 12. The hem reinforcement panels 36 are in line with the bottom panels 14, 16. The drawstring holes 22 are punched through the hem reinforcement panels 36. In addition to reinforcing the hem 34, the hem reinforcement panels 36 tend to define a rectangular mouth, which is useful for holding the bag open when filling or emptying the bag. The dimensions of the rectangle defined by the hem reinforcement panels 34 are W×2W. Thus, the rectangular mouth of the bag is somewhat longer than the rectangle defined by the two bottom panels 14, 16 which, as discussed above, has dimensions of W×1.73W.

As further shown in FIG. 3, the hem reinforcement panels 36 are heat bonded to the uppermost edge of the front and rear faces 10, 12. The heat bonding process used in the present preferred embodiment leaves indented seams 38. The uppermost edge of the front and rear faces 10, 12 is then folded over the hem reinforcement panel 36, so that the lower edge of the hem reinforcement panel 36 now defines the upper edge of the front and rear faces 10, 12.

Figure 6:
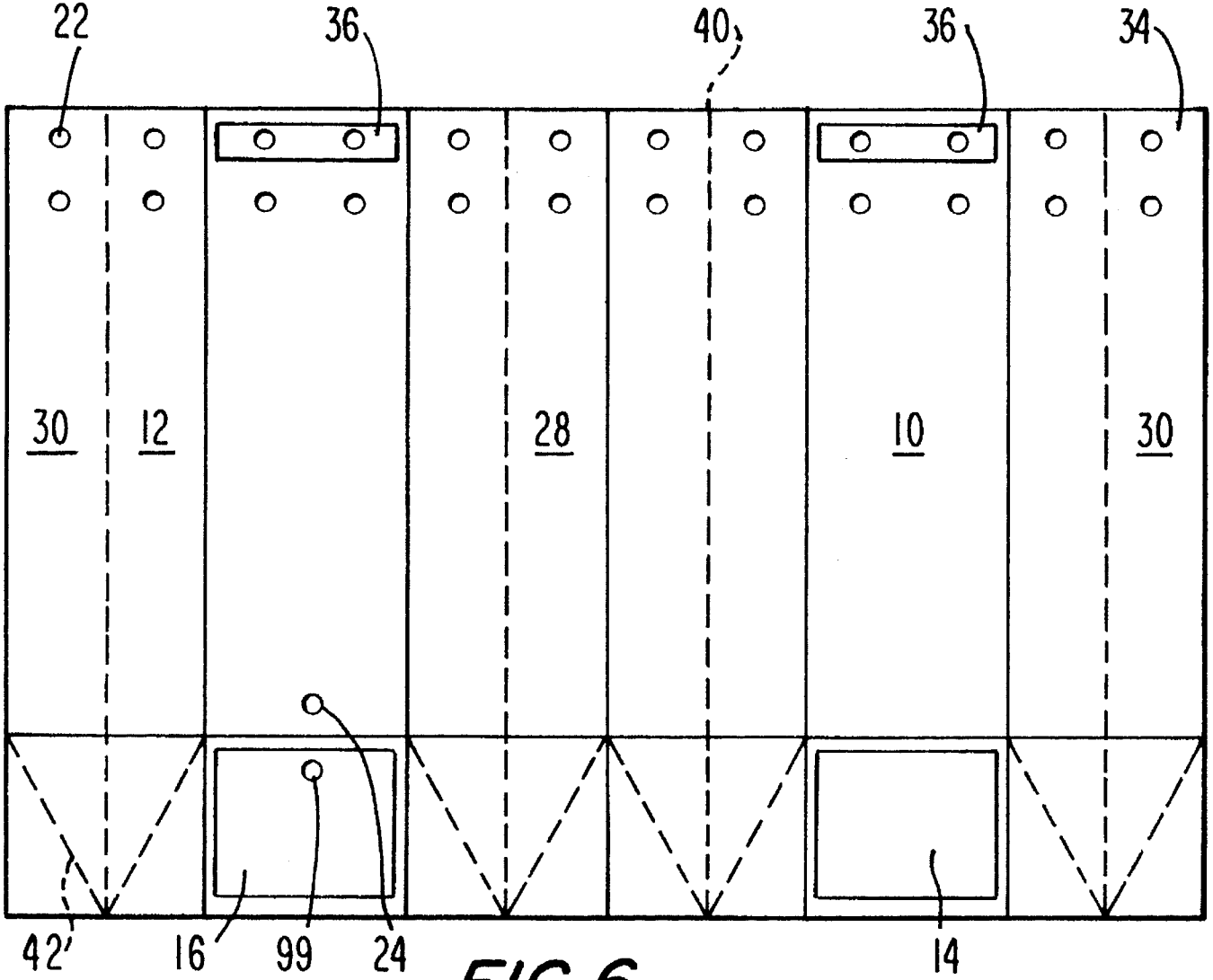
FIG. 6 is a plan view of a preferred embodiment of the present invention, showing a folding bag in the midst of the assembly process.

FIG. 6 shows a plan view of a partially assembled folding bag according to the present invention. The four faces of the bag are formed out of a single rectangular sheet of soft, pliable polypropylene of width 6W to which are mounted the rigid bottom panels 14, 16 and the hem reinforcement panels 36. The bottom panels 14, 16 are mounted at the bottom edge of the rectangular sheet at a distance of 2W apart. The hem reinforcement panels 36 are mounted to the upper edge of the rectangular sheet in alignment with the bottom panels 14, 16. Twelve pairs of drawstring holes 22 regularly spaced at ½W apart, are punched into the hem region 34. The drawstring holes 22 may be punched after the upper edge of the rectangular sheet is folded over to create the hem region 34, and after the right and left faces 28, 30 have been pleated and folded between the front and rear faces 10, 12. If accomplished in this manner, only two punches are required to create all 24 holes. This method has the added advantage of allowing quick threading of the drawstring 20 through the holes 22, since the holes 22 will all be in alignment immediately after they are punched. In addition, the alignment of the drawstring holes 22 also facilitates the rapid opening and closing of the mouth of the bag.

In the present preferred embodiment, the manufacturing of the folding bag from the rectangular sheet takes the following steps, although there are other possible methods of accomplishing the desired end result:

First, after the rectangular sheet is cut, the bottom panels 14, 16 and the hem reinforcement panels 36 are heat bonded into place, as shown in FIG. 6. The hem region 34 is then folded over the hem reinforcement panels 36 as shown in FIG. 3, and the rightmost and leftmost edges of the rectangle are then heat bonded to each other, creating a tube. The right and left faces of the bag are then pleated as described above along the creases indicated by the vertical broken lines 40 in FIG. 6, and the bottom edges of the four faces are heat bonded to each other as shown in FIG. 4. Finally, the drawstring holes 22, 24, 99 are punched and the drawstring 20 is passed through the holes 22, 24, 99 as shown in FIGS. 1A, 1B, and 2. The diagonal broken lines 42 in FIG. 6 show the creases created in the right and left faces 28, 30 when the bag is unfolded from its closed, first position into its open, second position.

What is claimed is:

1. A folding bag comprising:

a front face of width W, having a pliable portion and a rigid rectangular front base panel at its bottom;

a rear face of width W, having a pliable portion and a rigid rectangular rear base panel at its bottom;

the front base panel being hingeably joined to the rear base panel;

the bag being selectively openable from a first, closed position to a second, open position, such that in the first, closed position, the front face lies flat against the rear face and the front base panel lies flat against the rear base panel, in the second, open position, the front and rear base panels open to define a combined rectangular base, the pliable portion of the front and rear faces being substantially parallel to each other and defining the front and rear of the bag;

a plurality of side panels coupled between said front and rear faces; said plurality of side panels being pleated proximal to a bottom of said side panels such that the bag has a bottom attached to the front face, the rear face, and the plurality of sides, said bottom having a hexagonal shape, and the bag having an openable top formed from the front face, the rear face, and the plurality of sides, said openable top having a rectangular shape.

2. The folding bag of claim 1 wherein the front face, the rear face and the plurality of side panels further include a hemmed region defining the openable top.

3. The folding bag of claim 2 further comprising a drawstring threaded through said hemmed region of the front face, the rear face and the plurality of side panels.

4. A folding bag, comprising:

a rectangular front face having a length and of width W, having a pliable portion and including at its bottom a rigid, rectangular front base panel of length L and width W, a rectangular rear face having a length and of width W, having a pliable portion and including at its bottom a rigid, rectangular rear base panel of length L and width W, the front face and rear face being the same size and shape, the first and second faces being hingeably joined to each other at their bottom edges, the bag being selectively openable from a first, closed position to a second open position, such that in the first, closed position, the front face lies flat against the rear face and the front base panel lies flat against the rear base panel and in the second, open position, the front and rear base panels open to define a combined rectangular base of length 2 L and width W, the pliable portion of the front and rear faces being substantially parallel to each other at a distance of 2 L apart and defining the front and rear of the bag;

pliable right and left faces of the same length as the front and rear faces, the fight and left faces being pleated and attached at their edges to the front and rear faces such that when the front face and rear face are in their first, closed position, the bag lies flat, and when the front face and rear face are moved into their second, open position, the pleated right and left faces open to define the sides of the bag, the uppermost edges of the front, rear, right, and left faces defining the mouth of the bag;

the right and left faces are of width 2 W, and the right and left faces are pleated by three equidistant creases, such that the three creases define rectangles of width W, a first and third of the creases pointing towards the inside of the bag and a second of the creases pointing towards the outside of the bag, such that when the bag is in its first, closed position, the right and left faces fold flat between the front and rear faces, so that the front and rear faces and the folded right and left faces together define a rectangle of width W and of substantially uniform thickness;

the bottom edges of the pleated left and right faces are mounted to the hingeably joined portion of the first and second faces, such that when the front and rear base panels are in their second, open position, the bottom portion of the left and right faces, together with the front and rear base panels, define a hexagon;

the front, rear, right, and left faces include a hemmed region at their uppermost edges, the hemmed region defining the mouth of the bag when the bag is in its second, open position.

5. A folding bag according to claim 4, in which the hemmed region of the front face and hemmed region of the rear face each include a rigid hem reinforcing panel of width W, the hem reinforcing panels and the hemmed regions of the right and left faces tending to define a rectangle of width W and length 2 L when the bag is in its second, open position.

6. A folding bag according to claim 5, in which the hemmed region includes holes for receiving a drawstring.

7. A folding bag according to claim 6, in which the holes for receiving a drawstring are in alignment when the bag is in its first, closed position.

8. A folding bag according claim 7, in which the rear face includes an upper and a lower hole for receiving a drawstring, the lower hole penetrating the rear bottom panel proximate to its top, and the upper hole penetrating the pliable portion of the rear face proximate to the lower hole.

9. A folding bag according to claim 8, further including a drawstring threaded through the holes in the hemmed region and in the rear face.

10. A folding bag, comprising:

a rectangular front face having a length and of width W, having a pliable portion and including at its bottom a rigid, rectangular front base panel of length L and width W, a rectangular rear face having a length and of width W, having a pliable portion and including at its bottom a rigid, rectangular rear base panel of length L and width W, the front face and rear face being the same size and shape, the first and second faces being hingeably joined to each other at their bottom edges, the bag being selectively openable from a first, closed position to a second open position, such that in the first, closed position, the front face lies flat against the rear face and the front base panel lies flat against the rear base panel and in the second, open position, the front and rear base panels open to define a combined rectangular base of length 2 L and width W, the pliable portion of the front and rear faces being substantially parallel to each other at a distance of 2 L apart and defining the front and rear of the bag;

pliable right and left faces of the same length as the front and rear faces, the right and left faces being pleated and attached at their edges to the front and rear faces such that when the front face and the rear face are in their first, closed position, the bag lies flat, and when the front face and rear face are moved into their second, open position, the pleated right and left faces open to define the sides of the bag, the uppermost edges of the front, rear, right, and left faces defining the mouth of the bag;

the right and left faces are of width 2 W, and the right and left faces are pleated by three equidistant creases, such that the three creases define rectangles of width W, a first and third of the creases pointing towards the inside of the bag and a second of the creases pointing towards the outside of the bag, such that when the bag is in its first, closed position, the right and left faces fold flat between the front and rear faces, so that the front and rear faces and the folded right and left faces together define a rectangle of width W and of substantially uniform thickness;

the bottom edges of the pleated left and right faces are mounted to the hingeably joined first and second faces, such that when the front and rear base panels are in their second, open position, the bottom portion of the left and right faces, together with the front and rear base panels, define a hexagon;

the front, rear, right, and left faces include a hemmed region at their uppermost edges, the hemmed region defining the mouth of the bag when the bag is in its second, open position, the hemmed region of the front face and the hemmed region of the rear face each include a rigid hem reinforcing panel of width W, the hem reinforcing panels and the hemmed regions of the right and left faces tending to define a rectangle of width W and length 2 L when the bag is in its second, open position, the hemmed region includes holes for receiving a drawstring, the holes for receiving a drawstring are in alignment when the bag is in its first, closed position;

the rear face includes an upper and a lower hole for receiving a drawstring, the lower hole penetrating the rear bottom panel proximate to its top, and the upper hole penetrating the pliable portion of the rear face proximate to the lower hole.

11. A folding bag according to claim 10, further including a drawstring threaded through the holes in the hemmed region and in the rear face.

* * * * *